US006729829B2

(12) United States Patent
Zimmer

(10) Patent No.: US 6,729,829 B2
(45) Date of Patent: May 4, 2004

(54) WHEELCHAIR VEHICLE ACCESS SYSTEM

(75) Inventor: Paul H. Zimmer, Jacksonville, FL (US)

(73) Assignee: Sherrod Vans of Jacksonville, Inc., Jacksonville, FL (US)

( * ) Notice: Subject to any disclaimer, the term of this patent is extended or adjusted under 35 U.S.C. 154(b) by 0 days.

(21) Appl. No.: 10/313,160

(22) Filed: Dec. 6, 2002

(65) Prior Publication Data

US 2003/0108412 A1 Jun. 12, 2003

Related U.S. Application Data

(60) Provisional application No. 60/338,305, filed on Dec. 7, 2001.

(51) Int. Cl.[7] ..... B65F 3/00

(52) U.S. Cl. ..... 414/522; 414/921; 296/65.04

(58) Field of Search ..... 414/522, 537, 414/921; 296/65.01, 65.04; 297/DIG. 4

(56) References Cited

U.S. PATENT DOCUMENTS

| | | | | |
|---|---|---|---|---|
| 3,865,427 | A | | 2/1975 | Delany |
| 4,084,713 | A | | 4/1978 | Rohrs et al. |
| 4,142,641 | A | * | 3/1979 | Dake ..... 414/541 |
| 4,354,791 | A | | 10/1982 | Antonellis |
| 4,457,663 | A | | 7/1984 | Hems et al. |
| 4,643,446 | A | | 2/1987 | Murphy et al. |
| 4,661,035 | A | | 4/1987 | Danielsson |
| 4,669,943 | A | * | 6/1987 | Zamotin ..... 414/343 |
| 4,728,119 | A | | 3/1988 | Sigafoo |
| 4,805,954 | A | | 2/1989 | Lazaroff |
| 5,110,173 | A | | 5/1992 | Megna |
| 5,259,081 | A | | 11/1993 | Henderson |
| 5,466,111 | A | | 11/1995 | Meyer |
| 5,674,041 | A | | 10/1997 | Smith, Jr. et al. |
| 5,678,973 | A | | 10/1997 | Cox |
| 5,871,329 | A | | 2/1999 | Tidrick et al. |
| 6,098,995 | A | | 8/2000 | Danis |
| 6,416,272 | B1 | | 7/2002 | Suehiro et al. |

FOREIGN PATENT DOCUMENTS

| | | |
|---|---|---|
| JP | 11290385 A | 10/1999 |

* cited by examiner

*Primary Examiner*—Khoi H. Tran
(74) *Attorney, Agent, or Firm*—Thomas C. Saitta

(57) ABSTRACT

A wheelchair vehicle access system, wherein the wheelchair has a detachable seat connected to a carriage, and the vehicle has a folding ramp and a pathway for movement of the seat. The carriage locks onto the ramp and the seat is detached and moved on the vehicle pathway to a desired location, where it is secured in place. The ramp is then folded, which brings the carriage into the vehicle. To unload, the ramp is extended, the seat is released and rolled back onto the carriage.

20 Claims, 6 Drawing Sheets

WHEELCHAIR VEHICLE ACCESS SYSTEM

This application claims the benefit of U.S. Provisional Application Ser. No. 60/338,305, filed Dec. 7, 2001.

BACKGROUND OF THE INVENTION

This invention relates generally to the field of wheelchairs, and more particularly to the field of wheelchair and vehicle entry systems where operative means are provided for the wheelchair to be taken or loaded into the vehicle. More particularly, the invention relates to such systems where the seat component of the wheelchair is detachable from the wheeled carriage component, such that the seat component becomes the vehicle seat for the user, and where entry into the vehicle is fully automated such that the user can independently and without assistance make entry into the vehicle, position and secure the seat component in the vehicle, load the carriage component into the vehicle, ride in or drive the vehicle, unload the carriage component, and exit the vehicle onto a wheelchair for external mobility.

Disabled individuals having limited or complete loss of their ability to walk or stand, but who otherwise retain full or partial use of their upper body and arms, can utilize self-propelled or powered wheelchairs for mobility. Typical wheelchairs comprise a seat permanently attached to a wheeled frame or carriage usually comprising a pair of larger rear wheels for stability and propulsion efficiency and a pair of smaller front wheels for directional guidance. Wheelchairs may be manually powered, whereby the user grips and rotates the large rear wheels to move the chair in the desired direction, or may be propelled by power means, such as a battery-powered electric motor used to rotate the wheels. Wheelchairs are commonly constructed to be collapsible for easier storage, such that the wheelchair can be put into a vehicle trunk, placed onto an external rack, or loaded into the interior of a van after the user is positioned in the seat of a vehicle. In most instances, a wheelchair user requires the assistance of another person for entry into and exit from a vehicle, either in terms of physically transferring the user from the wheelchair into the vehicle or from the vehicle to the wheelchair, or in terms of loading the empty wheelchair itself into the vehicle after the user is situated in the vehicle and then unloading the wheelchair for use at the destination, or both. This often requires a significant amount of time and effort, and in the case where the disabled individual is larger than the assisting person or when the disabled person has limited upper body strength, can be a very difficult task.

Attempts to address the problem have primarily been directed to providing powered lift means or ramps on larger vehicles such as vans, whereby the occupied wheelchair can be lifted or rolled into the vehicle and then secured in place, without requiring the user to exit or be removed from the wheelchair. The height of common wheelchairs in use usually requires vans to be adapted by raising the roof and/or lowering part of the floor to accommodate the height of the wheelchair and occupant, and usually requires the structural integrity of the vehicle to be compromised by cutting into the chassis or other framing components, moving the gas tank, relocating wires, etc. Alternatively, the wheelchair may be constructed with collapsible or retractable wheels such that its overall height is reduced when placed into the vehicle, but this wheelchair construction is less stable and precludes wheelchairs with large power components. Another strategy has been to construct wheelchairs in a manner whereby the seat component is detachable from the wheeled carriage component. Receiving means are provided in the vehicle such that the seat component can be transferred into the vehicle, with the carriage component loaded separately. The invention at hand takes this approach to the problem, but improves over the designs currently known.

Examples of systems where the entire wheelchair is lifted into the vehicle are given in U.S. Pat. No. 4,456,663 to Hems et al., U.S. Pat. No. 4,661,035 to Danielsson, U.S. Pat. No. 5,466,111 to Meyer, and U.S. Pat. No. 6,416,272 to Suehiro et al. In Hems et al. '663, Danielsson '035, and Suehiro '272, a mounting arm is swiveled outward from the door opening. The wheelchair is attached to the mounting arm and the wheels are raised, such that the wheelchair can be pivoted into the vehicle. In Meyer '111, the wheelchair is connected to mounting means on the inside of the vehicle door and the wheels are raised. Closure of the door orients the wheelchair properly in the vehicle.

Examples of ramps specifically designed to provide vehicle entry and exit means for a wheelchair are shown in U.S. Pat. No. 4,084,713 to Rohrs et al., U.S. Pat. No. 5,259,081 to Henderson, and U.S. Pat. No. 5,871,329 to Tidrick et al. The ramps are intermediately hinged such that they can be vertically oriented in a folded configuration when retracted. The user advances the wheelchair up the ramp to a space in the vehicle. The ramp is then folded to fit within the vehicle.

The alternative solution of providing a wheelchair having a chair or seat structure detachable from the wheeled carriage structure is shown in U.S. Pat. No. 3,865,427 to Delany, U.S. Pat. No. 4,643,446 to Murphy et al., U.S. Pat. No. 4,728,119 to Sigafoo, U.S. Pat. No. 5,110,173 to Megna, and U.S. Pat. No. 5,674,041 to Smith, Jr. et al. In Deleany '427, the seat structure is provided with rollers which allow it to be transferred to a track mounted in the vehicle door, such that the seat structure is properly positioned in the vehicle when the door is closed. In Antonellis '791, the seat portion detaches and slides onto a pair of parallel tracks disposed on the vehicle seat. The Murphy et al. '446 and Sigafoo '119 devices are wheelchairs where the rear wheels and main frame portion are removed from the front wheels and seat portion, with the seat portion placed onto the vehicle seat. Megna '173 sows a detachable seat structure which slides onto a pair of tracks which are part of a support structure built into the vehicle. Smith, Jr. et al. '041 shows a detachable seat structure which slides over and is placed onto the vehicle seat.

It is an object of this invention to provide in combination a wheelchair and a vehicle entry and exit access system for individuals having limited or total loss of the use of their legs, but who retain upper body and arm functionality, such that the wheelchair user is able to independently and without assistance make entry into the vehicle using a retractable ramp assembly and runway, position and secure the detachable seat assembly component of the wheelchair in the vehicle for use as a vehicle seat during vehicle transport, automatically retract the ramp assembly while loading the carriage assembly component of the wheelchair into the vehicle, ride in or drive the vehicle while seated in the seat assembly component, automatically deploy the ramp assembly to unload the carriage assembly component upon arrival at the destination, and exit the vehicle by releasing the seat assembly component, traveling the runway to the ramp, rejoining the seat assembly component onto the carriage assembly component forming the complete wheelchair for external mobility, and moving down the extended ramp. It is a further object to provide such a system which can be incorporated in the vehicle during initial manufacture or retrofitted at a later date without the necessity of altering in negative manner the structural integrity of the vehicle. It is a further object to provide such a system wherein the seat assembly component of the wheelchair may be adapted from a standard vehicle seat manufactured by the vehicle manufacturer.

SUMMARY OF THE INVENTION

The invention comprises a wheelchair vehicle access system for a motorized vehicle such as a van, wherein the wheelchair is comprised of a chair or seat component or assembly mounted on castors, rollers or the like, and which is detachably connected to a wheeled carriage component or assembly, the seat preferably being an original equipment manufacturer (O.E.M.) vehicle seat for a given make of van. A folding ramp is connected to the vehicle such that it can be automatically extended through the open vehicle side door to contact the ground for entry to and exit from the vehicle, and which can be automatically retracted into a folded configuration for compact storage when the vehicle is in use. The ramp is provided with locking means to receive the wheelchair in a manner which locks the wheelchair carriage assembly to the ramp when the wheelchair is rolled or driven up the travel surface of the ramp. The high end of the travel surface of the ramp is positioned lower than the floor of the vehicle when the ramp is extended, with the ramp further comprising a bridge member which is positioned above the travel surface of the ramp at a height even with the vehicle floor and even with the upper surface of the carriage assembly. With the seat assembly released from the carriage, the seat assembly may be rolled from the upper surface of the carriage assembly across the bridge member onto a runway disposed on the floor of the vehicle. The seat assembly is then rolled into the desired location in the vehicle and temporarily secured to the vehicle floor, either at the driver's position or at a passenger position. The ramp is then retracted into the vehicle with the carriage assembly still attached thereto, such that both the ramp in the folded configuration and the wheelchair carriage assembly are disposed internally, and the vehicle door is closed. To exit the vehicle, the user automatically opens the door and extends the ramp to the ground. With the ramp fully extended, the carriage assembly is now in the proper position to receive the seat assembly. The seat assembly is released from the vehicle and rolled along the runway onto the secured carriage assembly. The seat assembly is locked to the carriage assembly and the carriage assembly is released from the ramp. After clearing the ramp, the ramp is automatically retracted into the vehicle and the vehicle door is closed. Preferably, means are provided to kneel or lower one corner or side of the vehicle in order to minimize the slope of the extended ramp.

DETAILED DESCRIPTION OF THE INVENTION

With reference to the drawings, the invention will now be described in detail with regard for the best mode and preferred embodiment of the invention, a wheelchair vehicle access system. The purpose of this invention is to provide an automatic, user-controlled, powered mechanical means for the transfer of a handicapped person into and from a vehicle, such that assistance from others is not required for placement of the handicapped person or the loading and unloading of a wheelchair. The transfer means allows the handicapped user to occupy the driver's position or a passenger seat position and does not require the user to transfer between a wheelchair seat and a vehicle seat.

Figure 1:
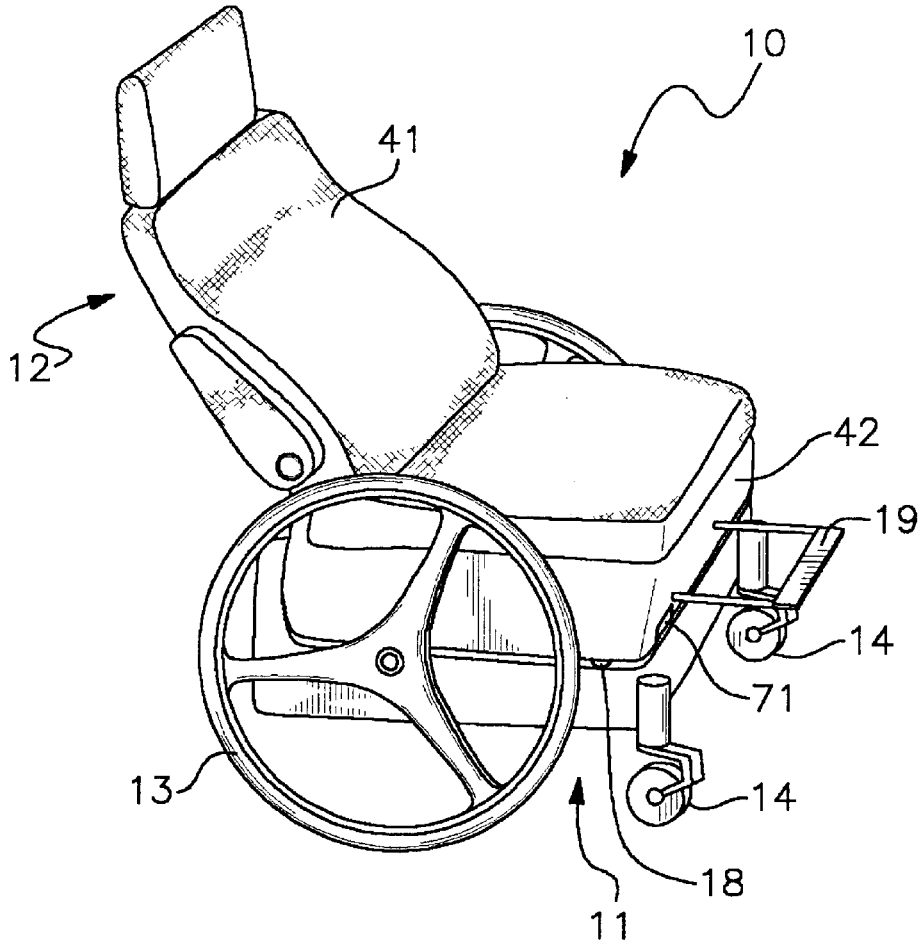
FIG. 1 is an illustration of a self-powered wheelchair comprising in combination a detachable seat assembly and a wheeled carriage assembly.
Figure 2:
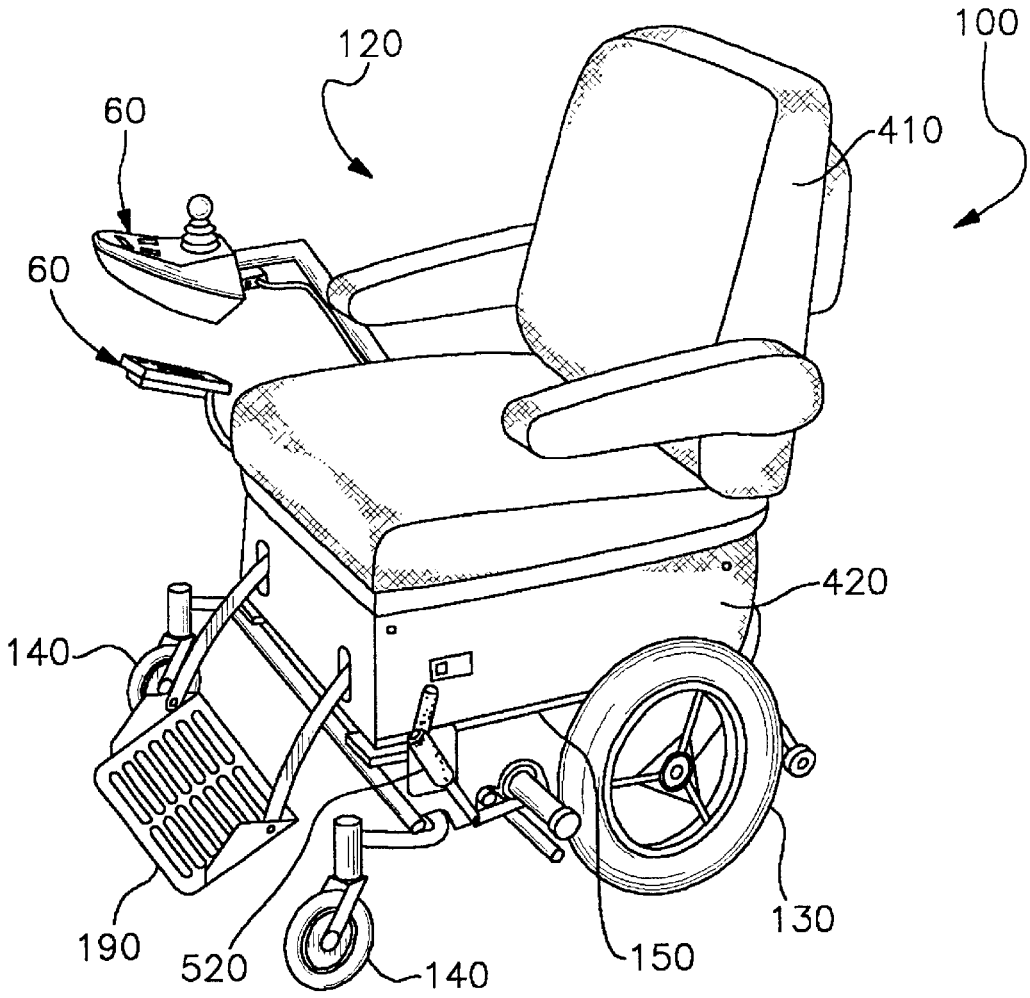
FIG. 2 is an illustration of a motorized wheelchair comprising in combination a detachable seat assembly and a wheeled carriage assembly.

FIGS. 1 and 2 illustrate alternative embodiments of a wheelchair 10 and a motorized wheelchair 100. The wheelchair 10 of FIG. 1 comprises in combination a detachable seat assembly component 12 and a wheeled carriage assembly component 11, and is self-propelled in that the user moves the wheelchair 10 by manually rotating the large rear wheels 13. The smaller front wheels 14 pivot to allow for steering of the wheelchair 10. Most preferably, an O.E.M. driver or passenger seat from a vehicle is adapted for use as the seat member 41 of seat assembly 12, although a separately designed seat member 41 equivalent to an O.E.M. vehicle seat, or even equivalent to typical wheelchair seats, may be utilized. Such an O.E.M. seat member 41 is comfortable, lightweight and typically incorporates power seat controls to adjust the seat height, tilt, and incline of the back support. A battery means is preferably incorporated in the seat assembly 12 to provide power for the seat adjustment features, thereby allowing seat controls to function even when not electrically coupled to the vehicle 90 itself. Electrical connector means 71 are provided for electrical communication with a vehicle mounted electrical port 95. The seat assembly 12 is most preferably provided with a foot rest 19, which may be manually or automatically adjustable and/or retractable, and which may be provided in addition to a secondary foot rest attached to the carriage assembly 11.

The seat assembly 12 further comprises a base member 42 onto which the seat member 41 is mounted. The base member 42 is provided on its underside with roller means 18, such as castors, wheels or the like, such that the seat assembly 12 is supported in the proper upright position when the seat assembly 12 is removed from the carriage assembly 11, and further such that the location of the seat assembly 12 can be easily changed even when occupied. Castors are the preferred choice for the roller means 18 such that the seat assembly 12 can be easily moved in different directions.

The carriage assembly 11 is adapted to releasably receive the seat assembly 12 and is the supporting frame for the seat assembly 12 when the seat assembly 12 is combined with the carriage assembly 11 to create the wheelchair 10 for mobility outside of the vehicle 90. Preferably a feature of the carriage assembly 11 is an underslung cantilevered axle design that allows the O.E.M. seat 41 to fit down and in between the large wheels 13 resulting in a low center of gravity. The carriage assembly 11 comprises the large rear wheels 13 used for propulsion of the wheelchair 10 and the smaller front wheels 14 used for turning. The carriage assembly 11 is provided on its upper surface with seat base receiving means 15, which preferably comprises a generally flat, relatively hard surface on which the roller means 18 of the seat assembly 12 easily move. Lateral guides or shoulders 17 may also be provided as guide means for receiving the seat assembly 12. Alternatively, properly positioned receiving channels or grooves corresponding to the location of the roller means 18 may be provided as the seat base receiving means 15.

Seat assembly locking means 16 are provided to secure the seat assembly 12 to the carriage assembly 11 when the combination is to be used as a wheelchair 10 outside of the vehicle. The seat assembly locking means 16 may comprise automatic, powered or manually controlled mechanical interlocking means, or any equivalent means to secure the seating assembly 12 to the carriage assembly 11 in a releasable manner. For example, a spring loaded latch 51 may be provided on the seat base receiving means 15 such that the latch 51 retains a detent or post member positioned on the underside of the seat base 42. A release lever 52 is then provided to unlock the seat assembly locking means 16 to allow the seat assembly 12 to be moved from the carriage assembly 11.

The wheelchair 100 of FIG. 2 is a powered version, such that the rear wheels 130 are rotated by a motor mounted in the wheelchair 100 and comprises in combination a detachable seat assembly 120 and a wheeled carriage assembly 110. The front wheels 140 pivot to allow for steering of the wheelchair 100. Most preferably, an O.E.M. driver or passenger seat from a vehicle is adapted for use as the seat member 410 of seat assembly 120, although a separately designed seat equivalent to an O.E.M. vehicle seat or typical wheelchair seat may be utilized. A battery means is preferably incorporated in the seat assembly 120 to provide power for the seat adjustment features, thereby allowing the seat controls to function independently when not electrically coupled to the vehicle. The seat assembly 120 is most preferably provided with a foot rest 190, which may be manually or automatically adjustable and/or retractable, and which may be provided in addition to a secondary foot rest attached to the carriage assembly 110.

The seat assembly 120 further comprises a base member 420 onto which the seat member 410 is mounted. The base member 420 is provided on its underside with roller means 180, such as castors, wheels or the like, such that the seat assembly 120 is supported in the proper upright position when the seat assembly 120 is removed from the carriage assembly 110, and further such that the seat assembly 120 can be rolled relatively easily on the roller means 180 even when occupied. Castors are the preferred choice for the roller means 180 such that the seat assembly 120 can be easily moved in different directions.

The carriage assembly 110 is adapted to releasably receive the seat assembly 120 and is the supporting frame for the seat assembly 120 when the seat assembly 120 is combined with the carriage assembly 110 to create the wheelchair 100 for mobility outside of the vehicle 90. The carriage assembly 110 comprises the large rear wheels 130 used for propulsion of the wheelchair 100 and the smaller front wheels 140 used for turning. Most preferably, the carriage assembly 110 is provided on its upper surface with seat base receiving means 150, which preferably comprises a generally flat, relatively hard surface on which the roller means 180 of the seat assembly 120 easily move. Lateral guide shoulders and a rear wall may be provided as guide means for receiving the seat assembly 120. Alternatively, properly positioned receiving channels or grooves corresponding to the location of the roller means 180 may be provided as the seat base receiving means 150.

Seat assembly locking means similar to seat assembly locking means 16 are provided to secure the seat assembly 120 to the carriage assembly 110 when the combination is to be used as a wheelchair 100 outside of the vehicle. The seat assembly locking means for wheelchair 100 may comprise automatic, powered or manually controlled mechanical interlocking means, or any equivalent means to secure the seating assembly 120 to the carriage assembly 110 on a temporary basis. For example, a spring loaded latch may be provided on the seat base receiving means 150 such that the latch retains a detent or post member positioned on the underside of the seat base 420. A release lever 520 is then provided to unlock the seat assembly locking means to allow the seat assembly 120 to be moved from the carriage assembly 110.

The wheelchairs 10 and 100 illustrated in FIGS. 1 and 2 are representative of suitable wheelchairs able to be utilized in the invention, and particular design, size, configuration and other elements may vary, provided that the wheelchair of the invention comprises a detachable seat component or assembly 12 or 120 that is mounted onto a wheeled carriage component or assembly 11 or 110 such that the seat component 12 or 120 can be separated from the carriage component 12 or 120.

Figure 3:
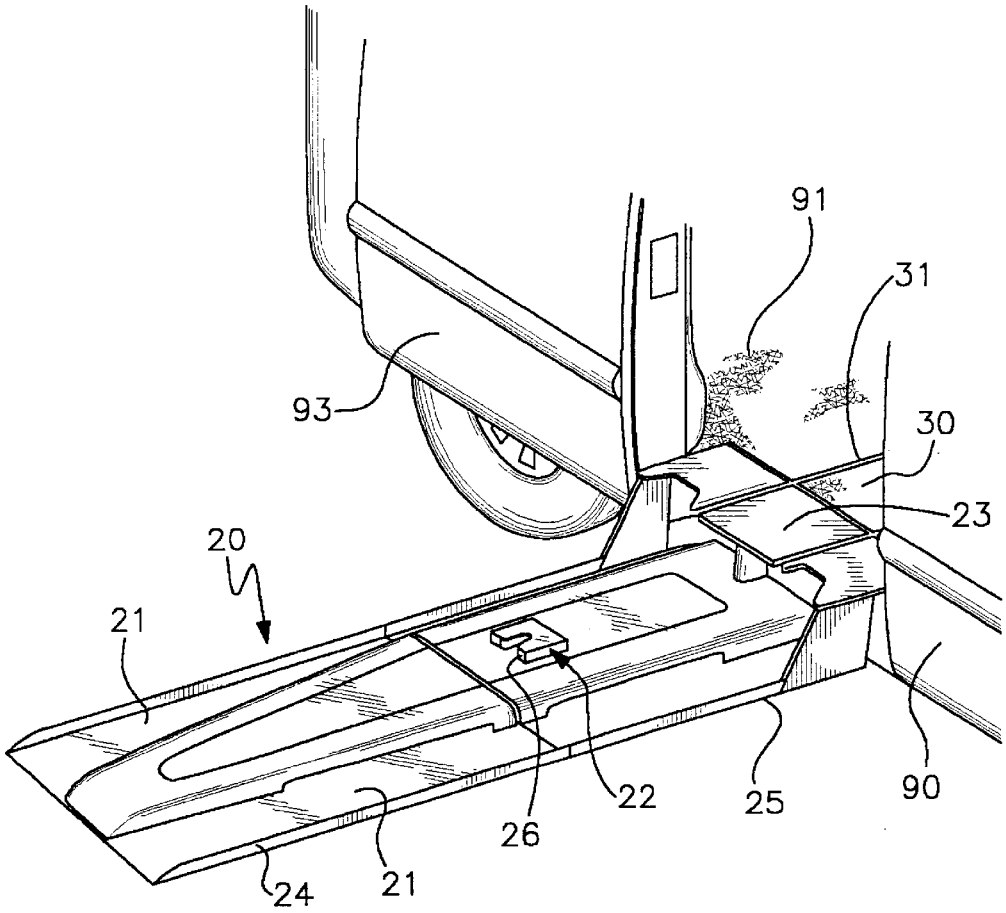
FIG. 3 is an illustration of the vehicle ramp in the extended position.
Figure 4:
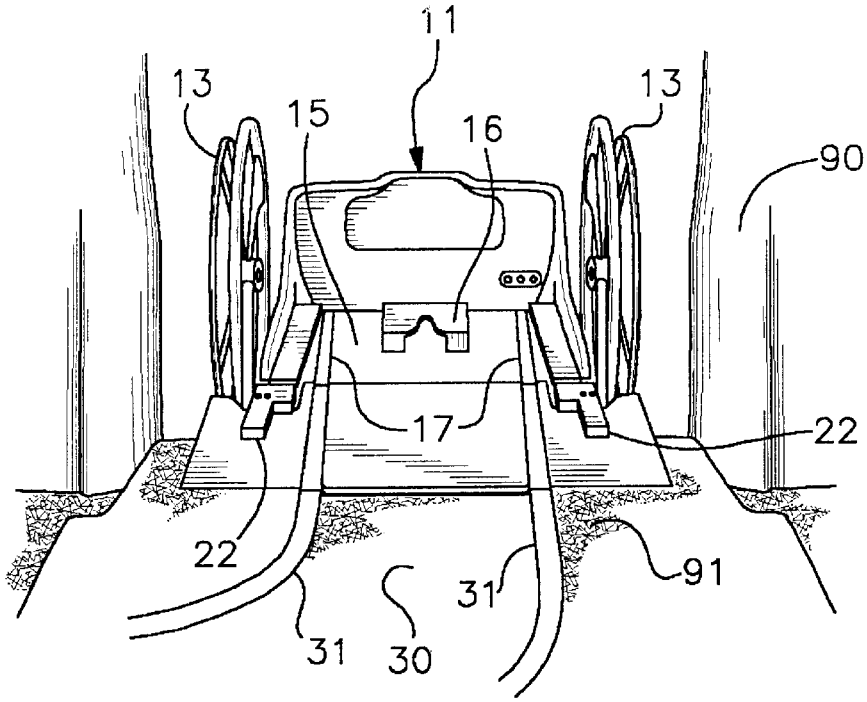
FIG. 4 is a view from the interior of the vehicle showing the carriage assembly connected to the extended ramp, the seat assembly having been detached and moved into position within the vehicle.

A retractable ramp 20, as shown in FIG. 3, extends from the vehicle 90 to the ground when in the fully extended configuration, and when retracted in the folded configuration is positioned just within the right hand passenger side sliding door 93 of the vehicle 90. The ramp 20 is preferably fully automated and remotely controlled, and is installed such that it cannot be activated while the sliding door 93 of the vehicle 90 is closed. The ramp 20 may be powered for example by a heavy duty 12 V motor with 2000 LB torque turning at 4 RPM harnessed to a machine type triple sprocket and chain drive with total travel action of 110 degrees. The ramp 20 power drive system is preferably located under the vehicle floor 91 between the frame at the right side sliding door 93 and is sealed with a protective weatherproof shroud. The ramp 20 is preferably constructed of rigid aircraft aluminum plate or similar material and should be designed to carry up to 500 pounds. Rubber tread is preferably bonded to the travel surface 21 to increase traction for the wheelchair wheels 13/130 and 14/140, and a series of courtesy lights may be provided to illuminate the ramp 20 for nighttime use. The length of ramp 20 is preferably designed to have an incline of approximately 6 degrees or less when the vehicle 90 is parked on level ground and the ramp 20 is fully extended.

Figure 6:
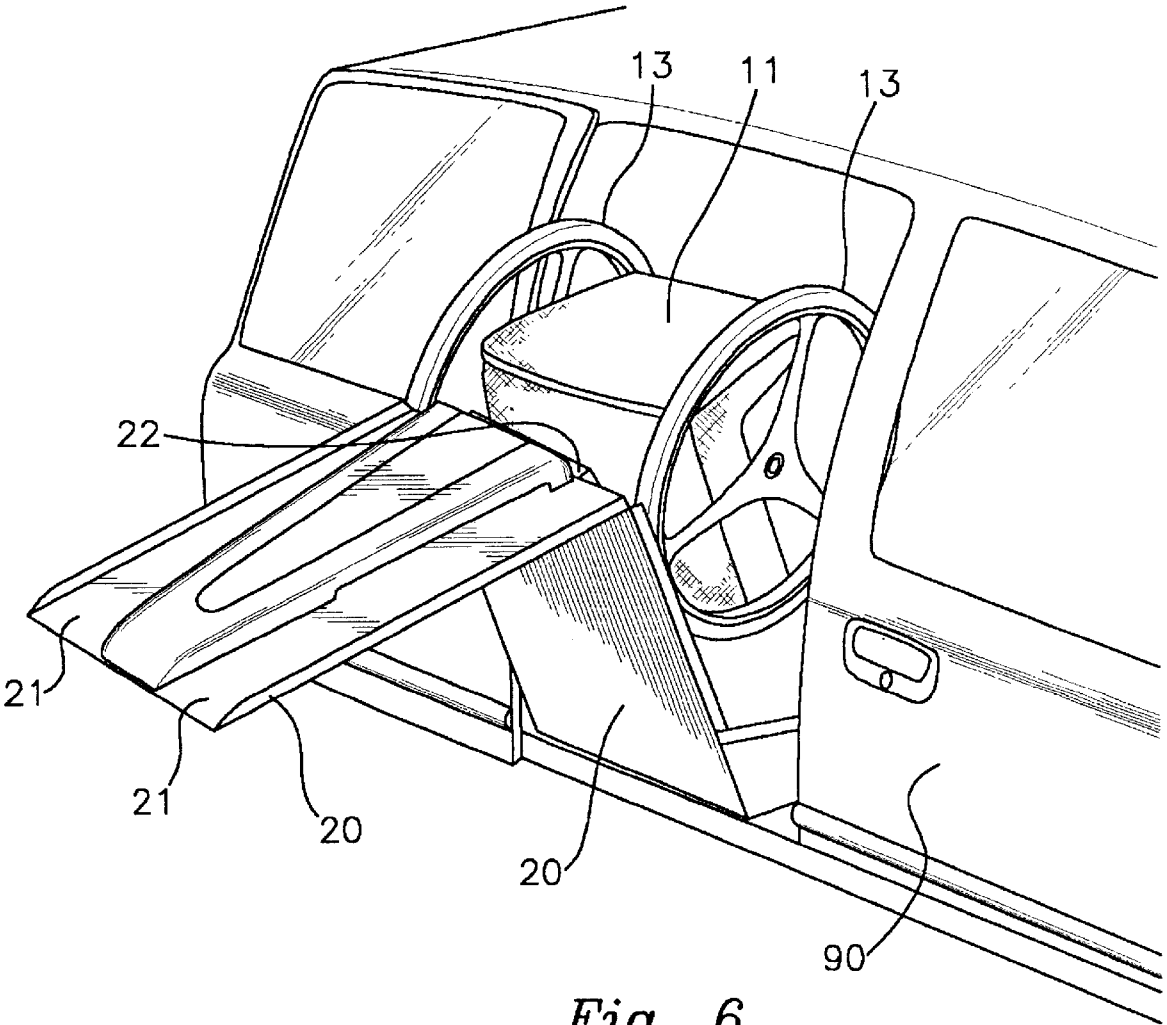
FIG. 6 shows the ramp during the folding or unfolding operation with the carriage assembly attached.

The ramp 20 folds as it is being retracted and unfolds as it is being extended, as shown in FIG. 6, and comprises a distal section 24 and a proximal carriage receiving section 25, the carriage receiving section 25 being hingedly connected to the vehicle 90 and the free end of the distal section 24 adapted to contact the ground when extended. Carriage locking means 22 are provided to secure the carriage assembly 11/110 on the carriage receiving section 25 of ramp 20, and carriage locking means 22 comprises automatic, powered or manually controlled mechanical means, or any equivalent means to secure the carriage assembly 10/110 on a temporary basis. For example, a spring loaded latch 26 may be provided on the proximal carriage receiving section 25 of ramp 20, such that the latch 26 retains a detent or post member positioned on the underside of the carriage assembly 11/110 when the wheelchair 10/100 is driven to the top of the ramp 20. A release lever or remotely controlled release means is provided to unlock the carriage locking means 22 to allow the wheelchair to be moved down the ramp 20 for exiting. The carriage locking means 22 further serves to retain the carriage assembly 11/110 on the ramp carriage receiving section 25 when the ramp 20 is folded to fit within the interior of the vehicle 90.

The highest portion of the travel surface 21 of the ramp 20 in the extended configuration is lower than the vehicle interior floor 91 by several inches, the distance being substantially equal to the height of the seat base receiving means 15/150. Disposed above the travel surface 21 is a bridge member 23. The bridge member 23 is pivotally connected on or adjacent to the vehicle floor 91, and extends out from the vehicle 90 at a height so as to be even with the upper surface of the seat base receiving means 15/150 on the carriage assembly 11/110. In this manner, when the ramp 20 is in the extended position, the bridge member 23 aligns with the seat base receiving means 15/150 such that the seat assembly 12/120 can be rolled off the carriage assembly 11/110 onto the bridge member 23, and vice versa. The bridge member 23 is provided with a relatively hard surface for ease of movement of the seat assembly 12/120.

Figure 5:
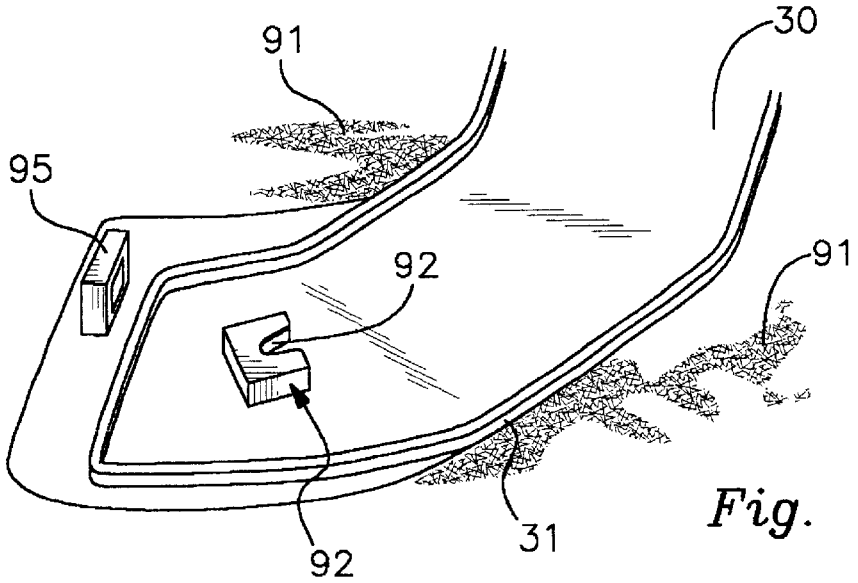
FIG. 5 shows the runway leading to the driver's seat.
Figure 7:
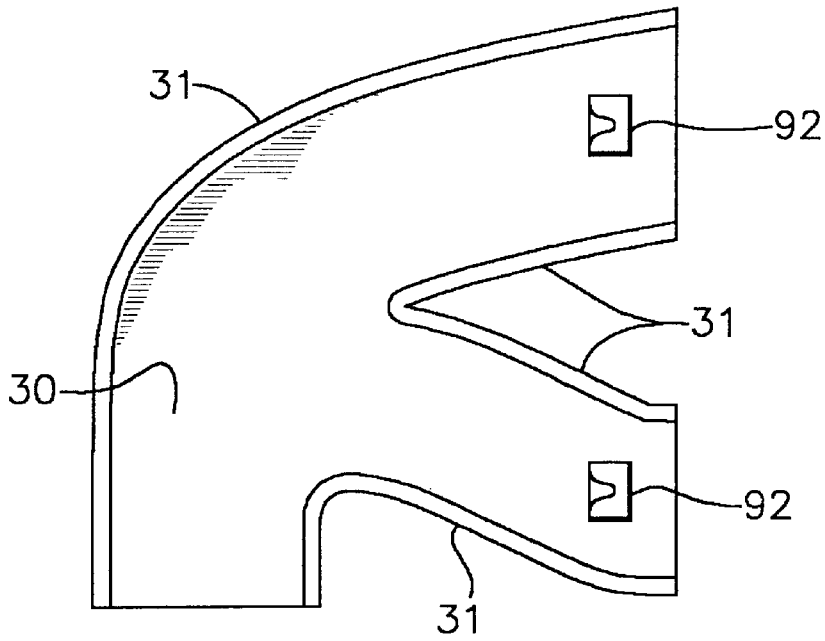
FIG. 7 shows an alternative embodiment of the vehicle runway, wherein the seat assembly may be positioned at either the drover's location or a passenger location.

The bridge member 23 aligns with a guideway, pathway or runway 30 disposed on the vehicle floor 91. The runway 30 has a relatively hard, smooth, low friction surface such that the seat assembly 12/120 will roll relatively easily, and is preferably constructed of high-impact, molded ABS which is secured over the carpeted floor area that leads to the driver's position in front of the steering wheel, as shown FIG. 5, to the front passenger position, to a rear passenger seat position, or to a combination of these positions, as shown in FIG. 7. The runway 30 is preferably provided with raised lateral guides or shoulder members 31 to control the travel direction of the seat assembly 12/120 during movement of the seat assembly 12/120. At the end of the runway 30 where the seat assembly 12/120 is to be secured during vehicle movement, vehicle seat locking means 92 is provided, which may comprise automatic, powered or manually controlled mechanical means, or any equivalent means to secure the seat assembly 12/120 in a fixed location on a temporary basis. For example, a spring loaded or electronic latch 94 may be provided, such that the latch 94 retains a detent or post member positioned on the underside of the seat assembly 12/120 when the seat assembly 12/120 is positioned at the desired location in the vehicle 90. A release lever or remotely controlled release means is then provided to unlock the vehicle seat locking means 92 to allow the seat assembly 12/120 to be moved down the runway 30. The seat locking means 92 preferably engages automatically.

In the most preferred embodiment, a powered wheelchair 100 is provided with electronic control means 60 positioned for easy accessibility by the user. The control means 60 preferably comprises a joystick or similar means for operational control of the wheeled carriage assembly 110 in order to control movement and direction of the wheelchair 100 when in use outside of the vehicle 90, as well as to control seat adjustment features such as tilt and height, the position of the automatic foot rest 19, automatic seat assembly locking means 16, automatic seat locking means 92 in the vehicle 90, the vehicle sliding door 93, the retraction and deployment of the ramp 20, etc.

In order that the ramp 20 not be excessively long or excessively steep when deployed from the vehicle 90, while maintaining standard clearance for the underside of the vehicle 90 when it is being driven, a mechanical lowering or kneeling system is preferably provided, preferably using an electrically powered screw jack system such that one side or corner of the vehicle 90 can lowered. Alternatively, hydraulic lifting cylinders or other mechanical means could also be utilized. A jack stem is disposed to travel through the vehicle floor 91 directly above the right rear wheel leaf spring. It is supported with steel mounting plates and a jack stem retainer foot, which clamps to the right rear leaf spring. This lowering system is preferably activated remotely and is automatically limited to the correct stop and start positions such that there is a smooth transition between the ramp 20 and the runway 30.

The operation and use of the wheelchair vehicle access system for entry and exit of the vehicle 90 is accomplished by a series of ordered steps using the components and elements described above. First, in the preferred embodiment, the kneeling system at the right rear suspension of the vehicle 90 is activated to lower the vehicle 90 at the sliding door entrance threshold a precise distance. This insures the deployment of the ramp 20 will be at the same and correct degree of incline every time. The vehicle sliding door 93 is opened automatically and the ramp 20 automatically deployed into the fully extended position external to the vehicle 90.

The user then advances the wheelchair 10/100 up the ramp 20. When the wheelchair carriage assembly 11/110 reaches the load/unload position at the top of ramp 20, the carriage locking means 22 is triggered to secure the wheelchair carriage assembly 11/110 in the correct position relative to the bridge member 23 and the vehicle floor 91. With the wheelchair carriage assembly 11/110 locked in place the seat assembly 12/120, with the occupant still seated, is released from the carriage assembly 11/110 and rolled onto the runway 30. The seat assembly 12/120 is then advanced to the driver's position or the passenger position, where it is temporarily secured by seat locking means 92.

Preferably, when the occupant is secured in the driver's position, the vehicle 90 cannot be started until the ramp 20, with the wheelchair carriage assembly 11/110 firmly locked in place, is retracted into the vehicle 90, the sliding door 93 is closed, and the lowered right rear suspension is returned to normal driving height. Upon full retraction of the ramp 20, the ramp distal section 24 and the ramp carriage receiving section 25 are generally vertically disposed, with the wheelchair carriage assembly 11/110 occupying a position behind the front passenger seat of the vehicle 90.

Upon arriving at one's destination the exiting procedure is essentially the reverse of boarding. With the engine turned off, the vehicle 90 is lowered, the door 93 is opened and the ramp 20 is extended. The occupant releases and rolls the seat assembly 12/120 down the runway 30 guided by the travel guides 31 and over the bridge member 23 onto the carriage assembly 11/110 which is still secured to the ramp 20. The seat assembly 12/120 automatically locks in place on the carriage assembly 11/110. The carriage assembly 1/110 is released from the ramp 20 and the wheelchair 10/100 is rolled down the ramp 20 onto the ground. Once off the ramp 20, the user activates the remote control such that the ramp 20 retracts, the sliding door 93 closes, and the vehicle 90 is returned to its normal height.

I claim:

1. A wheelchair vehicle access system wherein the occupant of a wheelchair can without outside assistance by other persons enter and exit a vehicle as well as load and unload a wheelchair for mobility outside of the vehicle, said system comprising:

a wheelchair adapted for mobility of an occupant outside of a vehicle, said wheelchair comprising a seat assembly and a wheeled carriage assembly, wherein said seat assembly is detachably connected to said carriage assembly;

a vehicle comprising a retractable ramp adapted to extend from said vehicle in an extended configuration and to be disposed within said vehicle in a retracted configuration, said retractable ramp comprising carriage locking means to temporarily lock said carriage assembly to said retractable ramp upon said wheelchair being rolled onto said ramp, such that said carriage assembly is carried by said ramp between said extended and retracted configurations after said seat assembly is detached from said carriage assembly;

whereby with said carriage assembly locked to said retractable ramp in the extended configuration, said seat assembly is adapted to roll into said vehicle upon being detached from said carriage assembly.

2. The system of claim 1, wherein said retractable ramp further comprises a distal section and a carriage receiving section, said carriage locking means being disposed on said carriage receiving section, wherein said distal section and said carriage receiving section are hingedly joined such that said retractable ramp is folded in said retracted configuration.

3. The system of claim 1, wherein said vehicle further comprises a vehicle floor and a runway disposed on said vehicle floor, said runway receiving said seat assembly when said seat assembly is detached from said carriage assembly.

4. The system of claim 3, wherein said retractable ramp further comprises a travel surface and a bridge member, said bridge member being disposed above said travel surface and connecting to said runway, such that said bridge member first receives said seat assembly when said seat assembly is detached from said carriage assembly.

5. The system of claim 1, wherein said vehicle further comprises seat locking means to temporarily secure said seat assembly within said vehicle.

6. The system of claim 1, wherein said seat assembly comprises a seat and a seat base, wherein said seat base is provided with roller means for movement of said seat assembly, and wherein said carriage assembly comprises seat base receiving means to receive said roller means.

7. The system of claim 1, wherein said wheelchair further comprises seat assembly locking means to connect said seat assembly to said carriage assembly.

8. A wheelchair vehicle access system wherein the occupant of a wheelchair can without outside assistance by other persons enter and exit a vehicle as well as load and unload a wheelchair for mobility outside of the vehicle, said system comprising:

a wheelchair for mobility of an occupant outside of a vehicle, said wheelchair comprising a seat assembly and a wheeled carriage assembly, wherein said seat assembly is detachably connected to said carriage assembly and is provided with roller means for movement of said seat assembly separate from said carriage assembly;

a vehicle comprising a powered retractable ramp adapted to extend from said vehicle in an extended configuration and to be disposed within said vehicle in a retracted configuration, said retractable ramp comprising a distal section and a carriage receiving section, said carriage locking means being disposed on said carriage receiving section, wherein said distal section and said carriage receiving section are hingedly joined such that said retractable ramp is folded in said retracted configuration, and further comprising carriage locking means to temporarily lock said carriage assembly to said retractable ramp upon said wheelchair being rolled onto said ramp, such that said carriage assembly is carried by said ramp between said extended and retracted configurations after said seat assembly has been detached from said carriage assembly;

said vehicle further comprising a vehicle floor and a runway disposed on said vehicle floor, said runway receiving said seat assembly when said seat assembly is detached from said carriage assembly, and further comprising seat locking means to temporarily secure said seat assembly within said vehicle;

whereby with said carriage assembly locked to said retractable ramp in the extended configuration, said seat assembly is adapted to roll onto said runway of said vehicle upon being detached from said carriage assembly.

9. The system of claim 8, wherein said retractable ramp further comprises a travel surface and a bridge member, said bridge member being disposed above said travel surface and connecting to said runway, such that said bridge member first receives said seat assembly when said seat assembly is detached from said carriage assembly.

10. The system of claim 8, wherein said wheelchair further comprises seat assembly locking means to connect said seat assembly to said carriage assembly.

11. The system of claim 8, wherein said seat assembly comprises a seat and a seat base, wherein said seat comprises an O.E.M. seat of said vehicle.

12. The system of claim 8, wherein said runway extends to a location within said vehicle such that said seat assembly becomes a driver's seat during operation of said vehicle.

13. The system of claim 8, wherein said runway extends to a location within said vehicle such that said seat assembly becomes a passenger seat during operation of said vehicle.

14. The system of claim 8, wherein said runway extends to two locations within said vehicle such that said seat assembly becomes either a driver's seat or a passenger seat during operation of said vehicle.

15. A wheelchair vehicle access system wherein the occupant of a wheelchair can without outside assistance by other persons enter and exit a vehicle as well as load and unload a wheelchair for mobility outside of the vehicle, said system comprising:

a wheelchair for mobility of an occupant outside of a vehicle, said wheelchair comprising a seat assembly and a wheeled carriage assembly, wherein said seat assembly is detachably connected to said carriage assembly and is provided with roller means for movement of said seat assembly separate from said carriage assembly, and further comprising control means adapted for operation of said wheelchair and for operation of a retractable ramp mounted to a vehicle;

a vehicle comprising a powered retractable ramp adapted to extend from said vehicle in an extended configuration and to be disposed within said vehicle in a retracted configuration, said retractable ramp comprising a distal section and a carriage receiving section, said carriage locking means being disposed on said carriage receiving section, wherein said distal section and said carriage receiving section are hingedly joined such that said retractable ramp is folded in said retracted configuration, and further comprising carriage locking means to temporarily lock said carriage assembly to said retractable ramp upon said wheelchair being rolled onto said ramp, such that said carriage assembly is carried by said ramp between said extended configuration with said carriage assembly external to said vehicle and said retracted configuration with said carriage assembly internal to said vehicle after said seat assembly has been detached from said carriage assembly;

said vehicle further comprising a vehicle floor and a runway disposed on said vehicle floor, said runway receiving said seat assembly when said seat assembly is detached from said carriage assembly, and further comprising seat locking means to temporarily secure said seat assembly within said vehicle;

whereby with said carriage assembly locked to said retractable ramp in the extended configuration, said seat assembly is adapted to roll onto said runway of said vehicle upon being detached from said carriage assembly.

16. The system of claim 15, wherein said retractable ramp further comprises a travel surface and a bridge member, said bridge member being disposed above said travel surface and connecting to said runway, such that said bridge member first receives said seat assembly when said seat assembly is detached from said carriage assembly.

17. The system of claim 15, wherein said seat assembly comprises a seat and a seat base, wherein said seat comprises an O.E.M. seat of said vehicle.

18. The system of claim 15, wherein said runway extends to a location within said vehicle such that said seat assembly becomes a driver's seat during operation of said vehicle.

19. The system of claim 15, wherein said runway extends to a location within said vehicle such that said seat assembly becomes a passenger seat during operation of said vehicle.

20. The system of claim 15, wherein said runway extends to two locations within said vehicle such that said seat assembly becomes either a driver's seat or a passenger seat during operation of said vehicle.

* * * * *